US006217492B1

(12) United States Patent
Huang

(10) Patent No.: US 6,217,492 B1
(45) Date of Patent: Apr. 17, 2001

(54) EMBRACING MECHANISM OF EXERCISE DEVICE

(76) Inventor: Chin-Lien Huang, 2F, No. 14, Ning Hsia E. 5 ST., Taichung (TW)

( * ) Notice: Subject to any disclaimer, the term of this patent is extended or adjusted under 35 U.S.C. 154(b) by 0 days.

(21) Appl. No.: 09/413,591

(22) Filed: Oct. 6, 1999

(51) Int. Cl.[7] ..... A63B 21/06
(52) U.S. Cl. ..... 482/100; 482/136
(58) Field of Search ..... 482/100, 136, 482/137

(56) References Cited

U.S. PATENT DOCUMENTS 4,494,751 * 1/1985 Schnell ..... 482/136
4,953,855 * 9/1990 Shields ..... 482/99
6,004,247 * 12/1999 Webber ..... 482/100

* cited by examiner

*Primary Examiner*—John Mulcahy
(74) *Attorney, Agent, or Firm*—Browdy and Neimark

(57) ABSTRACT

An exercise device comprises a frame body, a plurality of pulleys mounted on the frame body, a weight set, a plurality of ropes which are connected at one end thereof with the weight set and run through the pulleys, and an embracing mechanism which is mounted on the frame body and is formed of two pivoting members, two suspension arms, and two driven members. The pivoting members are fastened pivotally with the flame body and connected with the suspension arms. The driven members are pivoted between the pivoting members and the frame body and fastened with the free ends of the ropes and the pivoting members. When the suspension arms are exerted on by an external force, the suspension arms turn back and forth in a horizontal direction to bring about an embracing exercise. The suspension arms can be forced to turn in a vertical direction and stopped at a position to enable an exerciser to adjust the distance between the two suspension arms.

4 Claims, 4 Drawing Sheets

EMBRACING MECHANISM OF EXERCISE DEVICE

FIELD OF THE INVENTION

The present invention relates generally to an exercise device, and more particularly to an embracing mechanism of the exercise device.

BACKGROUND OF THE INVENTION

As shown in FIG. 1, a prior art exercise device 1 comprises a frame body 2, an embracing mechanism 3 mounted on the frame body 2, a weight set 4, a plurality of pulleys 5 mounted on the frame body 2, and a plurality of ropes 6 running through the pulleys 5 such that both ends of the ropes 6 are connected with the embracing mechanism 3 and the weight set 4. When a person uses the exercise device 1 to do the embracing exercise, the person must overcome the reaction force which is provided by the weight set 4 via the ropes 6.

The embracing mechanism 3 has two suspension arms 7 which are fastened pivotally with the frame body 2 such that the two suspension arms 7 are separated at an interval to facilitate the embracing of the suspension arms 7 with both elbows, or the holding of the suspension arms 7 with both hands of the person using the exercise device 1. The suspension arms 7 are fixed such that the distance between the two suspension arms 7 can not be adjusted in accordance with the body size of a person using the exercise device 1.

SUMMARY OF THE INVENTION

The primary objective of the present invention is to provide an exercise device with an embracing mechanism having two suspension arms which are adjustable in distance between the two suspension arms.

In keeping with the principle of the present invention, the foregoing objective of the present invention is attained by an exercise device comprising a frame body, a plurality of pulleys mounted on the frame body, a weight set, a plurality of ropes which run on the pulleys such that the ropes are fastened at one end thereof with the weight set, and an embracing mechanism mounted on the frame body and composed of two pivoting members, two suspension arms, and two driven members. The two pivoting members are fastened pivotally with the frame body. The two suspension arms are fastened pivotally with the two pivoting members. The two driven members are coaxially pivoted between the pivoting members and the frame body such that the two driven members are exerted on by the action force of the weight set via the ropes. The two suspension arms can be actuated by an external force to turn in a vertical surface such that the two suspension arms can be stopped at an appropriate position to enable the interval between the two suspension arms to adapt to the user's requirement.

DETAILED DESCRIPTION OF THE INVENTION

Figure 1:
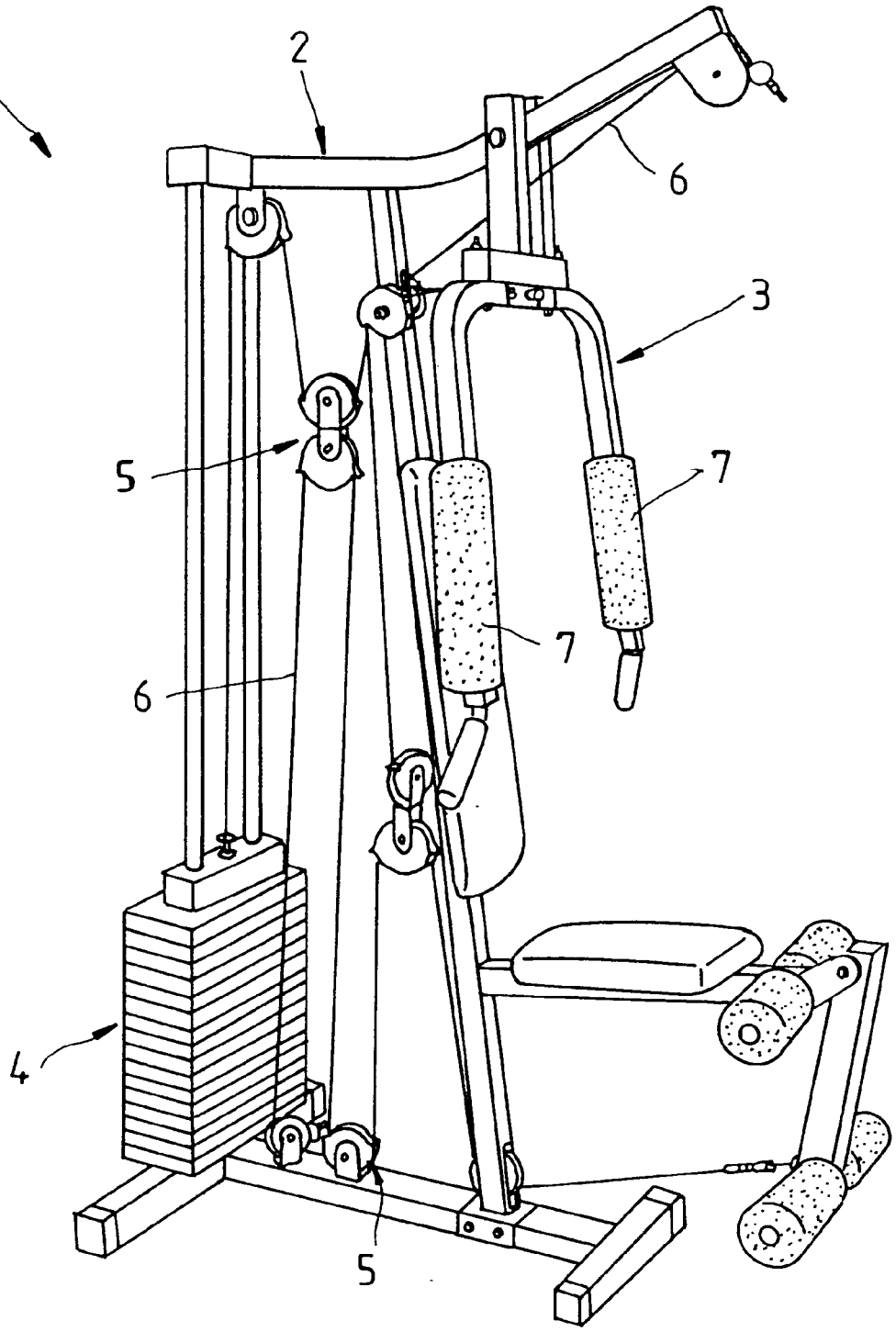
FIG. 1 PRIOR ART
FIG. 1 shows a perspective view of a prior art exercise device having an embracing mechanism.
Figure 2:
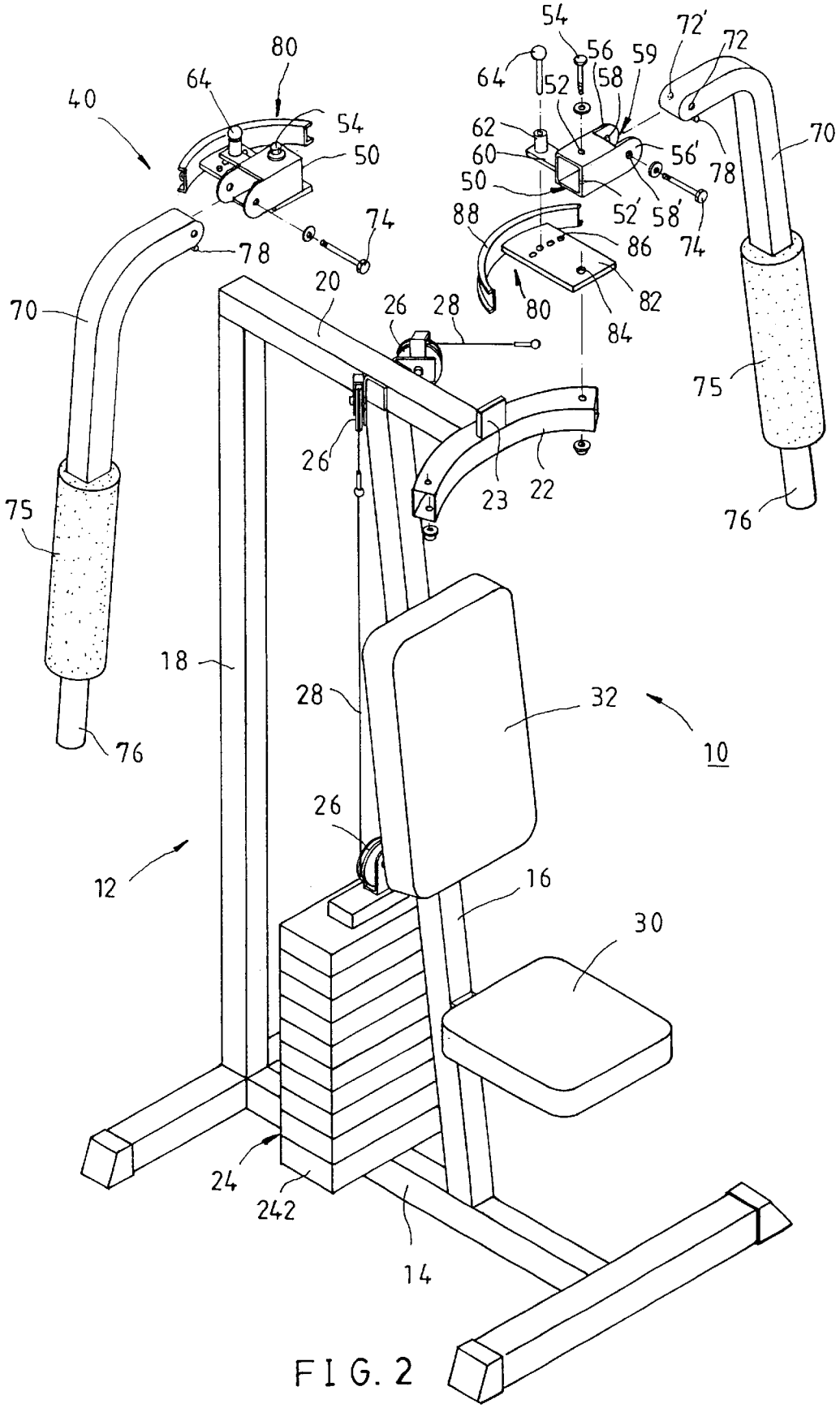
FIG. 2 shows an exploded view of a preferred embodiment of the present invention.
Figure 3:
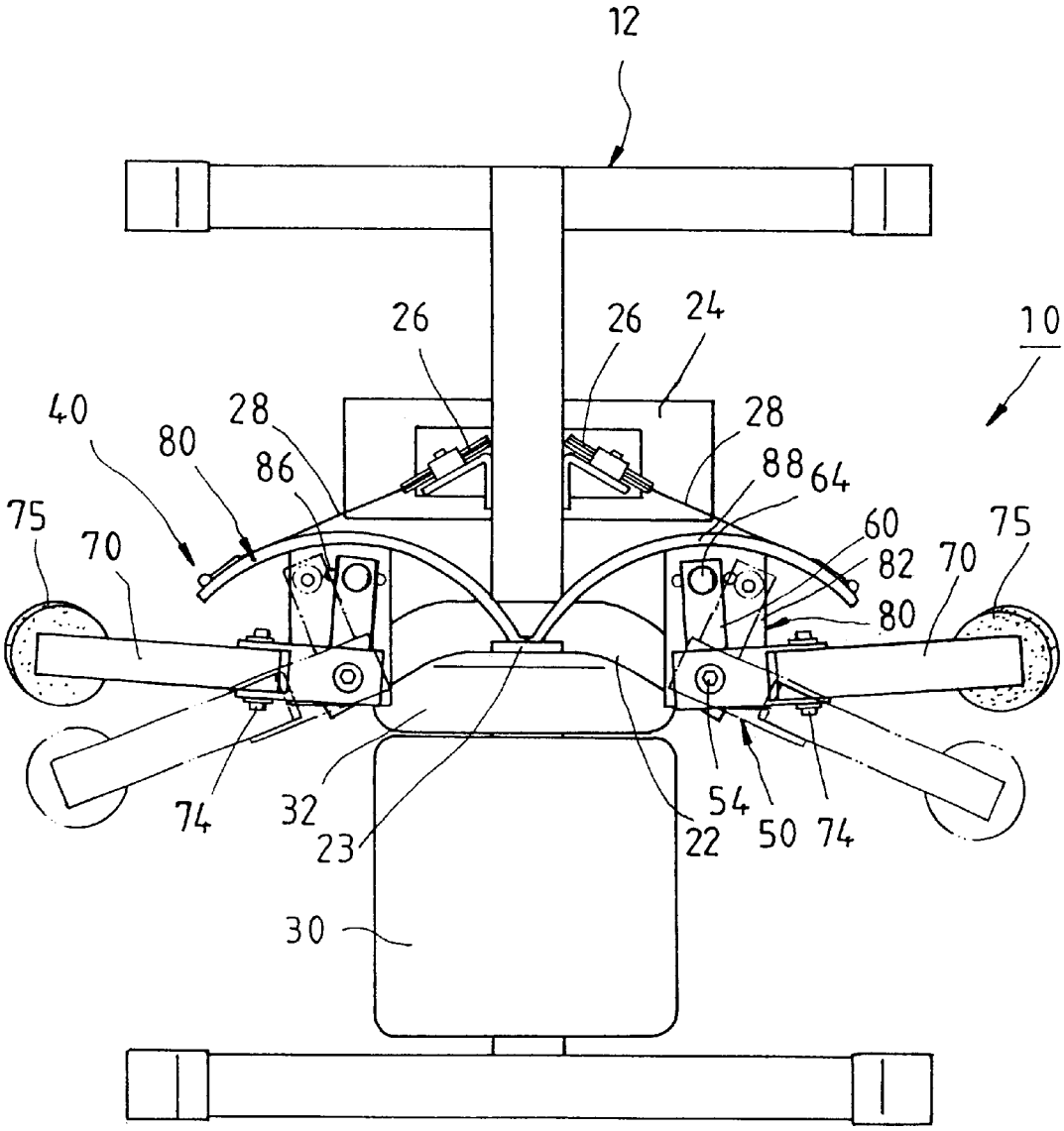
FIG. 3 shows a top view of the preferred embodiment of the present invention in combination.
Figure 4:
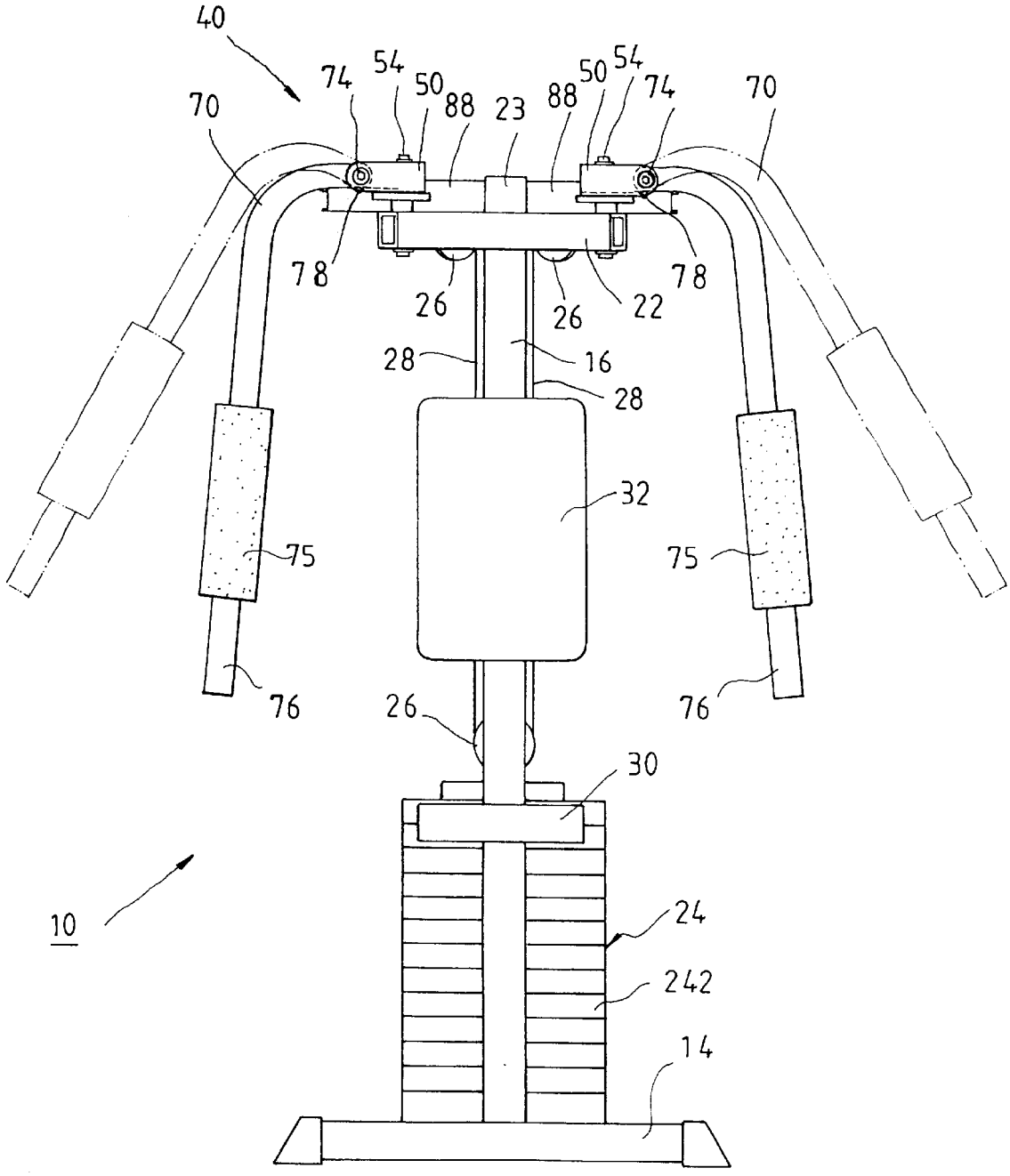
FIG. 4 shows a side view of the preferred embodiment of the present invention in combination.

As shown in FIGS. 2–4, an exercise device 10 of the preferred embodiment of the present invention comprises a frame body 12, a weight set 24, a plurality of pulleys 26, a plurality of ropes 28, a seat 30, a backrest 32, and an embracing mechanism 40.

The frame body 12 is formed of a bottom frame 14, a front longitudinal support rod 16 mounted on the bottom frame 14, a rear longitudinal support rod 18 mounted on the bottom frame 14, a top support rod 20 fastened with top ends of the front longitudinal support rod 16 and the rear longitudinal support rod 18. The top support rod 20 is provided at the front end thereof with an arcuate connection rod 22 having two open ends. The connection rod 22 is provided at the center thereof with a stop plate 23 extending upward and vertically therefrom. The weight set 24 is formed of a plurality of weights 242. The pulleys 26 are mounted on the frame body 12. The ropes 28 run on the pulleys 26 such that the ropes 28 are fastened at one end thereof with the weight set 24. The seat 30 and the backrest 32 are fastened with the front longitudinal support rod 16.

The embracing mechanism 40 is mounted on the connection rod 22 of the frame body 12 and is formed of two pivoting members 50, two suspension arms 70, and two driven members 80.

The pivoting members 50 are of a hollow rectangular construction and are provided in the upper and the lower sides thereof with a first threaded hole 52 (52') for fastening pivotally the pivoting members 50 with the free end of the connection rod 22 by a bolt 54 such that the pivoting members 50 turn horizontally. The pivoting members 50 are provided in the left and the right sides thereof with a lug 56 (56'), which is provided with a second threaded hole 58 (58'). Located between the two lugs 56 and 56' is a holding space 59. Each pivoting member 50 is provided in the lower side thereof with a rectangular connection piece 60 extending therefrom and having a pin seat 62. The pin seat 62 has a hollow interior in which a pin 64 is disposed.

The two suspension arms 70 are of an inverted L-shaped tubular construction and are rectangular in their cross sections. The top end of each suspension arm 70 is held in the holding space 59 of the pivoting member 50. The suspension arms 70 are provided with two threaded holes 72 and 72', which are corresponding in location to the second threaded holes 58 and 58' of the pivoting members 50. The suspension arms 70 are fastened pivotally with the lugs 56 (56') of the pivoting members 50 by bolts 74, which force two opposite sides of the lug 56 (56') to make an intimate contact with the suspension arms 70, thereby resulting in a friction force. Each suspension arm 70 can be exerted on by the force of a user of the exercise device 10 to turn in a vertical surface. In light of the effect of the fiction force, the suspension arm 70 in motion can be stopped at a place where the user stops exerting the force.

The body of each suspension arm 70 is provided with a rest pad 75 to facilitate the embracing of the suspension arm 70 by the user's elbow. The suspension arm 70 is provided at the bottom end thereof with a handle 76 which is intended to be held by a hand of the user engaging in the embracing exercise. Each suspension arm 70 is provided at the top end thereof with a cylindrical stop strip 78, which presses against one end of the lower side of the pivoting member 50 at such time when the suspension arm 70 is swiveled downward to locate at a predetermined position so as to reduce the distance between the two rest pads 75 or the two handles 76. As a result, the rotational motion of the suspension arms 70 is confined in a predetermined angle by the upper and the lower sides of the pivoting member 50. In other words, the two suspension arms 70 can be adjusted in position within the predetermined angle as desired by the user, thereby resulting in a change in the distance between the two rest pads 75 or the two handles 76.

Each driven member 80 has a rectangular locating plate 82 and an arcuate strip 88 fastened with the locating plate 82. The locating plate 82 is provided with a threaded hole 84 for pivoting the locating plate 82 between the connection rod 22 and each pivoting member 50. The locating plate 82 is provided with four locating holes 86 for receiving the pins 64 for enabling the pivoting member 50 to connect with the driven member 80 so as to turn together horizontally. When the pins 64 are received in the different locating holes 86, the angles between the pivoting member 50 and the driven member 80 are different. The driven member 80 is fastened with the rope 28 by the strip 88 so that the driven member 80 is exerted on by the action force of the weight set 24 via the ropes 28. When the suspension arm 70 is not exerted on horizontally by an external force, one end of the strip 88 urges the stop plate 23 of the frame body 12. Upon completion of the embracing exercise, the action of the urging of the stop plate 23 by the strip 88 can prevent the rotation of the suspension arm 70 by virtue of inertia, thereby providing the user with protection. The strip 88 has a U-shaped cross section to prevent the rope 28 from escaping.

The suspension arms 70 can be exerted on by elbows pressing against the rest pads 75 or by hands holding the handles 76 such that the suspension arms 70 are moved horizontally by the pivoting member 50 and each driven member 80. The horizontal motion is brought about in a reciprocating manner to bring about the embracing exercise. The initial angle of the embracing exercise can be adjusted by the pin 64 which is inserted into one of the locating holes 86. The suspension arms 70 can be forced to turn in the vertical plane such that the suspension arms 70 in motion can be stopped at an appropriate position so as to enable an exerciser to adjust the distance between the two suspension arms 70 in accordance with the need of the exerciser.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An exercise device comprising a frame body, a plurality of pulleys mounted on the frame body, a weight set, a plurality of ropes which are connected at one end thereof with the weight set such that the ropes run through the pulleys and an embracing mechanism mounted on the frame body and connected with the ropes; wherein said embracing mechanism comprises:

each of two pivoting members rotatably engaged at a first end to the frame body in spaced relationship to rotate in a horizontal plane, lug means engaged at a second end of each of the two pivoting members and to a suspension arm to permit the suspension arm to rotate in a vertical plane through a predetermined angle and be fixed by friction at a position within said angle; and two driven members rotatable in a horizontal plane on the frame body, said driven members being engaged to said pivoting members to rotate coaxially with said pivoting members, wherein said two driven members are connected with free ends of the ropes so as to enable said driven members to be acted on by an action force of the weight set.

2. The exercise device as defined in claim 1, wherein said pivoting members are provided in a lower side thereof with a connection piece having a pin seat with a through hole for a receiving pin, and said driven members have a plurality of holes, wherein said pivoting members are respectively rotated relative to said driven members so that the through hole of the pin seat selectively corresponds to a hole of said plurality of holes and a receiving pin is engaged in said through hole and the corresponding hole, so that different angles of rotation between the pivoting members and driven members are fixed.

3. The exercise device as defined in claim 1, wherein said driven members have an arcuate strip which is fastened with said locating plate and has a U-shaped cross section for holding securely the ropes.

4. The exercise device as defined in claim 1, wherein said suspension arms are provided with a stop strip serving to press against said pivoting member at such time when said suspension arms turn vertically downward to a predetermined position, thereby causing said suspension arms in motion to stop at the predetermined position.

* * * * *